US010424892B2

(12) United States Patent
Herbrechtsmeier

(10) Patent No.: US 10,424,892 B2
(45) **Date of Patent: *Sep. 24, 2019**

(54) HOLDING FRAME FOR A PLUG-TYPE CONNECTOR

(71) Applicant: HARTING Electric GmbH & Co. KG, Espelkamp (DE)

(72) Inventor: Heiko Herbrechtsmeier, Buende (DE)

(73) Assignee: HARTING ELECTRIC GMBH & CO. KG, Espelkamp (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/030,858

(22) PCT Filed: Dec. 11, 2014

(86) PCT No.: PCT/DE2014/100439
§ 371 (c)(1),
(2) Date: Apr. 20, 2016

(87) PCT Pub. No.: WO2015/085995
PCT Pub. Date: Jun. 18, 2015

(65) Prior Publication Data

US 2016/0285194 A1 Sep. 29, 2016

(30) Foreign Application Priority Data

Dec. 12, 2013 (DE) ..... 10 2013 113 975
Dec. 12, 2013 (DE) ..... 10 2013 113 976

(51) Int. Cl.
*H01R 43/20* (2006.01)
*H01R 43/18* (2006.01)
(Continued)

(52) U.S. Cl.
CPC ..... *H01R 43/20* (2013.01); *H01R 13/506* (2013.01); *H01R 13/514* (2013.01);
(Continued)

(58) Field of Classification Search
CPC .. H01R 13/506; H01R 13/514; H01R 13/518; H01R 13/652; H01R 43/18; H01R 43/20;
(Continued)

(56) References Cited

U.S. PATENT DOCUMENTS 3,544,951 A 12/1970 Roberts
3,576,520 A 4/1971 Stauffer ..... 339/198
(Continued)

FOREIGN PATENT DOCUMENTS

CN 1191400 A 8/1998
CN 1988277 A 6/2007
(Continued)

OTHER PUBLICATIONS

German Third Party Observation issued in application No. 10 2013 113 976.0, dated Apr. 26, 2016 (30pgs).
(Continued)

*Primary Examiner* — A. Dexter Tugbang
(74) *Attorney, Agent, or Firm* — Seed IP Law Group LLP

(57) ABSTRACT

A holding frame for a plug-type connector is intended to have good heat resistance and a high level of mechanical robustness and, when installed in a metallic plug-type connector housing, enable protective grounding while being convenient to use, in particular during the replacement of individual modules. To this end, a holding frame is provided having a rigid die-cast metal frame and cheek parts made of resilient sheet metal, the cheek parts being distinct from but coupled to the rigid die-cast metal frame to extend along opposing exterior sides of the longitudinal sidewalls of the rigid die-cast metal frame to provide a multi-layer sidewall structure, and each cheek part having a upper portion with at least one detent window which is configured to flex
(Continued)

Figure 1:
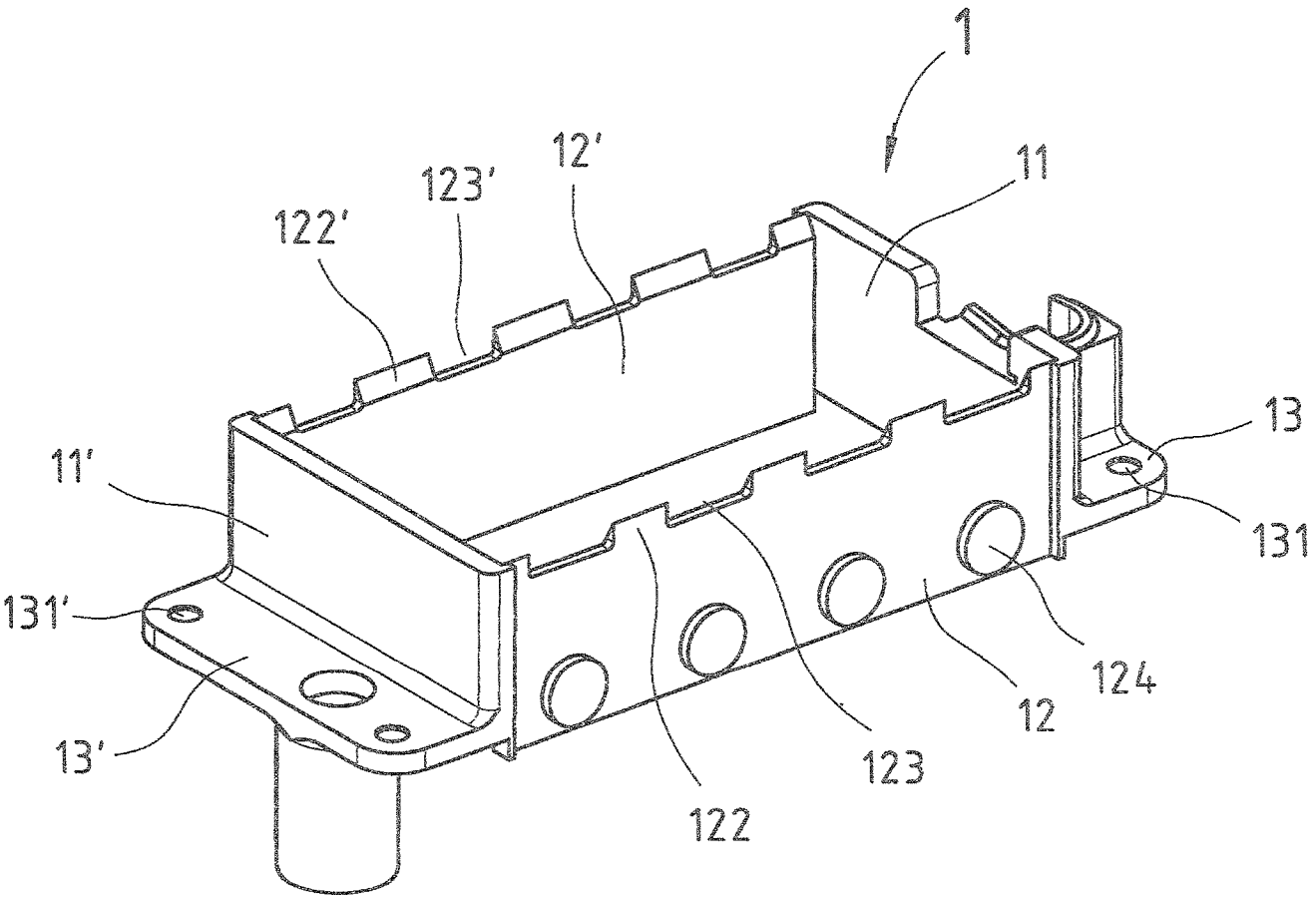

outwardly to an insertion state to receive a connector module and to return to a holding state to lock the connector module in place.

30 Claims, 5 Drawing Sheets

(51) Int. Cl.

| | |
|---|---|
| ***H01R 43/22*** | (2006.01) |
| ***H01R 13/518*** | (2006.01) |
| ***H01R 13/506*** | (2006.01) |
| ***H01R 13/514*** | (2006.01) |
| ***H01R 13/652*** | (2006.01) |

(52) U.S. Cl.
CPC ..... *H01R 13/518* (2013.01); *H01R 13/652* (2013.01); *H01R 43/18* (2013.01); *H01R 43/22* (2013.01); *Y10T 29/49137* (2015.01); *Y10T 29/49169* (2015.01); *Y10T 29/53252* (2015.01)

(58) Field of Classification Search
CPC ..... H01R 43/22; Y10T 29/49137; Y10T 29/49169; Y10T 29/53252; H05K 5/0004; H05K 5/0013; H04R 4/26
See application file for complete search history.

(56) References Cited

U.S. PATENT DOCUMENTS

| | | | | |
|---|---|---|---|---|
| 4,032,209 | A | 6/1977 | Rutkowski | 339/91 R |
| 4,090,764 | A | 5/1978 | Malsby et al. | |
| 4,621,885 | A | 11/1986 | Szczesny et al. | 339/91 R |
| 4,659,162 | A | 4/1987 | Cartesse | 339/128 |
| 4,735,583 | A | 4/1988 | Rudy, Jr. et al. | 439/350 |
| 4,952,172 | A | 8/1990 | Barkus et al. | |
| 5,090,920 | A | 2/1992 | Casey | |
| 5,352,133 | A | 10/1994 | Sampson | |
| 5,562,493 | A * | 10/1996 | Ferrill | H01R 13/518 439/536 |
| 5,913,690 | A | 6/1999 | Dechelette et al. | |
| 6,004,162 | A | 12/1999 | Harting et al. | 439/701 |
| 6,074,238 | A | 6/2000 | DeRoss et al. | |
| 6,196,869 | B1 | 3/2001 | Kay et al. | 13/648 |
| 6,556,411 | B1 | 4/2003 | Hoeft et al. | |
| 7,303,446 | B2 | 12/2007 | Hills et al. | |
| 7,316,591 | B2 | 1/2008 | Ferderer | 439/701 |
| 7,597,587 | B1 | 10/2009 | Duesterhoeft | |
| 7,979,985 | B2 | 7/2011 | Spitaels et al. | |
| 8,900,018 | B2 | 12/2014 | Riepe et al. | 439/701 |
| 2002/0072267 | A1 | 6/2002 | Bowling et al. | |
| 2005/0085129 | A1 | 4/2005 | Chiou et al. | |
| 2006/0258218 | A1 | 11/2006 | Chen | |
| 2007/0155252 | A1* | 7/2007 | Ferderer | H01R 13/518 439/680 |
| 2010/0091179 | A1 | 4/2010 | Murakami et al. | 348/374 |
| 2010/0144203 | A1* | 6/2010 | Glover | H01R 13/506 439/607.07 |
| 2010/0206702 | A1* | 8/2010 | Zhou | H01R 13/518 200/51.02 |
| 2010/0311286 | A1 | 12/2010 | Schrader | |
| 2010/0320883 | A1* | 12/2010 | Yang | H05K 5/0013 312/223.1 |
| 2011/0237107 | A1 | 9/2011 | Nagata et al. | |
| 2012/0244754 | A1 | 9/2012 | Riepe et al. | |
| 2013/0217268 | A1 | 8/2013 | Duan et al. | 439/660 |

FOREIGN PATENT DOCUMENTS

| | | | | |
|---|---|---|---|---|
| CN | 202333292 | U | 7/2012 | |
| CN | 202474421 | U | 10/2012 | |
| CN | 203277786 | U | 11/2013 | |
| DE | 18 16 371 | U | 7/1960 | |
| DE | 2014182 | | 10/1970 | 1/4 |
| DE | 2736079 | | 2/1979 | 13/513 |
| DE | 3851961 | | 6/1995 | 13/506 |
| DE | 29508095 | | 7/1995 | 13/514 |
| DE | 298 12 500 | U1 | 10/1998 | |
| DE | 10 2008 009 357 | A1 | 8/2009 | |
| DE | 20 2012 103 360 | U1 | 3/2013 | |
| DE | 202013103611 | | 9/2013 | 13/514 |
| DE | 102013113976 | | 6/2015 | 13/514 |
| EP | 0183587 | | 6/1986 | 13/73 |
| EP | 0570181 | | 5/1993 | 23/72 |
| EP | 0836246 | | 4/1998 | 13/64 |
| EP | 0860906 | | 8/1998 | 13/514 |
| EP | 1 495 522 | A | 10/2003 | |
| EP | 0860906 | | 5/2004 | 13/514 |
| EP | 1801927 | | 6/2007 | 13/518 |
| EP | 1801927 | | 5/2010 | 13/518 |
| EP | 2581991 | | 4/2013 | 13/506 |
| EP | 2930794 | | 10/2015 | 13/518 |
| FR | 2489609 | | 3/1982 | 13/518 |
| FR | 2 572 857 | A1 | 5/1986 | |
| FR | 2657469 | | 7/1991 | 13/514 |
| JP | 6-52924 | A | 2/1994 | |
| JP | 10-189150 | A | 7/1998 | |
| JP | 10-241777 | A | 9/1998 | |
| JP | 11-251016 | A | 9/1999 | |
| JP | 2008-84672 | A | 4/2008 | |
| JP | 2011204567 | A * | 10/2011 | |
| JP | 2011-228154 | A | 11/2011 | |
| KR | 10-2010-0086445 | A | 7/2010 | |
| RU | 92 746 | U1 | 3/2010 | |
| RU | 125 779 | U1 | 3/2013 | |
| WO | 2011/069522 | A1 | 6/2011 | |

OTHER PUBLICATIONS

Excerpt: "frame" definition, downloaded from wikipedia.org, May 11, 2016 (3 pgs).
Excerpt: "lateral" definition, downloaded from dictionary.com, May 11, 2016 (7 pgs).
German Office Action issued in application No. 10 2013 113 975.2, dated. Nov. 21, 2014 (4 pgs).
International Search Report and Written Opinion issued in application No. PCT/DE2014/100439, dated Apr. 9, 2015 (10 pgs).
Chinese Office Action and Search Report, dated Jun. 20, 2017, for Chinese Application No. 201480067749.6, 21 pages. (with English Translation).
Japanese Office Action, dated Jun. 2, 2017, for Japanese Application No. 2016-538506, 13 pages. (with English Translation).
Notice of Opposition, dated Jun. 28, 2017, for German Patent No. 10 2013 113 976, on behalf of Phoenix Contact GmbH & Co. KG, 44 pages. (with English Translation).
International Preliminary Report on Patentability issued in application No. PCT/DE2014/100439, dated Jun. 23, 2016 (7 pgs).
Letter from DTS PartmbB, Munich to German Patent and Trademark Office, Objections to the grant of a patent having the subject matter of the patent application with official file reference 10 2013 113 976.0, dated Apr. 26, 2016 (26 pgs).
Letter from Eisenführ Speiser Patentanwälte Rechtsanwälte PartGmbB, Bremen to German Patent and Trademark Office, Munich, "Regarding the third party objection of Apr. 26, 2016," dated May 24, 2016 (6 pgs).
German Patent and Trademark Office Notice, file reference 10 2013 113 975.2, dated Nov. 21, 2014 (2 pgs).
German Patent and Trademark Office Notice, file reference 10 2013 113 976.0, dated Nov. 21, 2014 (2 pgs).
Extract from Duden (online directory) relating to the term "lateral", downloaded Aug. 31, 2016 from http://www.duden.de/rechtschreibung/lateral (4 pgs).
Opposition Letter, DE 10 2013 113 976, dated Oct. 18, 2016 (36 pgs). English translation to follow.
Heavycon Modular feature classification (no translation), Phoenix Contact, Jul. 7, 2014 (4 pgs).
Photo, E3.1 (2 pgs). Details to follow.

(56) References Cited

OTHER PUBLICATIONS

Photo, Anlagel (1 pg). Details to follow.
Google internet search, MIXO modular units for multipole connectors 156-Treotham, Aug. 4, 2016 (8 pgs).
URL approval, Connectors for Use in Data, Signal, Control and Power Applications-Component, Aug. 1, 2013 (4 pgs).
ILME Supplement to CN.07 catalogue, New products 2010 (4 pgs).
ILME Supplement to CN.11 catalogue, New products 2011 (5 pgs).
ILME Supplement to CN.12 catalogue, New products 2012 (10 pgs).
ILME Supplement to CN.12 catalogue, Oct. 2013 (4 pgs).
ILME CN.12 Mehrpolige Steckverbinder für industrielle Anwendung (no translation) (6 pgs). Details to follow.
Definition of "Frame" from Wikipedia, Oct. 28, 2016 (1 pg).
Opposition Letter with cover letter (with translation), DE 10 2013 11.3 976, dated Oct. 18, 2016 (61 pgs).
Photo E3.1, listed under enclosures list of Opposition Letter, DE 10 2013 113 976, dated Oct. 18, 2016 (2 pgs).
Photo Anlagel, Phoenix product of Opposition Letter, DE 10 2013 113 976, dated Oct. 18, 2016 (1 pg).
ILME CN.12 Mehrpolige Steckverbinder für industrielle Anwendung (no translation), listed under enclosures list as E2.3 of Opposition Letter, DE 10 2013 113 976, dated Oct. 18, 2016 (6 pgs).
Notice of Opposition, dated Jan. 18, 2018, for European Patent No. 3 080 875, on behalf of Phoenix Contact GmbH & Co. KG, 36 pages.
Harting Elektronik GmbH, "Schwere Steckverbinder Han-Modular®," Product Catalog, Jan. 1999, 44 pages.
Canadian Intellectual Property Office, Office Action dated Feb. 20, 2018, for Canadian Application No. 2,930,052, 4 pages.
Rospatent, Decision on Grant dated Jan. 22, 2018, for Russian Application No. 2016125448/07(039852), 7 pages.

* cited by examiner

HOLDING FRAME FOR A PLUG-TYPE CONNECTOR

The invention relates to a holding frame according to the preamble of independent main claim 1.

The invention also relates to a method according to the preamble of independent coordinated claim 9.

Holding frames of this type are required in order to receive a plurality of modules of the same kind and/or also a plurality of different modules. By way of example, these modules can be insulating bodies, which are provided as contact carriers for electronic and electrical and possibly also for optical and/or pneumatic contacts. It is particularly important that the holding frame enables a regulation-compliant protective earthing according to plug-type connector standard EN61984, for example for insertion of the holding frame loaded with modules into a metal plug-type connector housing.

PRIOR ART

A holding frame for supporting plug-type connector modules and for installation in plug-type connector housings and/or for screwing to wall surfaces is known from document EP 0 860 906 B1, wherein the plug-type connector modules are inserted into the holding frame and supporting means on the plug-type connector modules cooperate with recesses provided on opposite wall parts (side parts) of the holding frame, wherein the recesses are formed as openings, which are closed on all sides, in the side parts of the holding frame, wherein the holding frame consists of two halves connected to one another in a hinged manner, wherein the holding frame separates transversely to the side parts of the frame, and wherein hinges are arranged in the fastening ends of the holding frame in such a way that when the holding frame is screwed onto a fastening surface the frame parts are oriented in such a way that the side parts of the holding frame are oriented at right angles to the fastening surface, and the plug-type connector modules are connected to the holding frame in an interlocking manner by means of the supporting means. Holding frames of this type are usually manufactured in practice in a diecasting method, in particular in a zinc diecasting method.

Document EP 2 581 991 A1 discloses a holding frame for plug-type connector modules which has two frame halves, which can be latched to one another by linear displacement of one frame half relative to the other frame half in a direction of displacement, wherein detent means corresponding to one another are provided on each of the frame halves and, in the event of linear displacement, latch the two frame halves to one another in two different latch positions, in which the frame halves are spaced apart from one another at a different distance.

It has been found in practice however that holding frames of this type require complex handling during assembly. By way of example, holding frames of this type must be unscrewed and/or unlatched from the plug-type connector as soon as even just a single module is to be replaced. Here, the other modules, the removal of which was not even desired, might also fall out of the holding frame and then have to be inserted again before the frame halves are screwed together and/or latched. Finally, all modules must be disposed simultaneously in their intended positions already before the frame halves are joined together so as to be ultimately fixed in the holding frame when the frame halves are joined together, which complicates the assembly.

Document EP 1 801 927 B1 discloses a holding frame that consists of a one-piece plastics injection-molded part. The holding frame is formed as a peripheral collar and has, on its plugging side, a plurality of wall segments separated by slots. Each two opposed wall segments form an insertion region for a plug module, wherein the wall segments have window-like openings, which serve to receive protrusions integrally molded on the narrow sides of the modules. A guide groove is also provided in each of the wall segments. The guide groove is formed above the openings by means of an outwardly offset window web, which on the inner side has an insertion bevel. In addition, the plug modules have detent arms, which are integrally molded on the narrow sides in a manner acting in the direction of the cable connections, and which latch beneath the lateral collar wall, such that two independent detent means fix the plug-type connector modules in the holding frame.

In the case of this prior art it is disadvantageous on the one hand that the holding frame is a holding frame formed from plastic, which holding frame is not suitable for protective earthing and therefore is not suitable for installation in metal plug-type connector housings. However, the use of metal plug-type connector housings presupposes a protective earthing of this type and is necessary in many cases, for example on account of the mechanical robustness and temperature resistance of said housings and the electrically shielding properties thereof, and is therefore desired by the customer. It has also been found that the production of the aforementioned plastics holding frames by means of injection molding is at the least problematic and can be implemented only with a high level of effort. Lastly, the heat resistance of a plastics holding frame of this type also is not always sufficient for particular applications, for example in the vicinity of a blast furnace. Lastly, the plastics material and the shape, in particular the strength of the holding frame at the relevant points, are determined primarily by the requirements placed on flexibility and not by those of temperature resistance.

PROBLEM

The problem addressed by the invention is that of specifying a design for a holding frame, which on the one hand has a good heat resistance and a high mechanical robustness and in particular enables an appropriate protective earthing, in particular a PE (protection earth), even in the case of installation in a metal plug-type connector housing, and on the other hand also ensures comfortable handling, in particular when replacing individual modules.

This problem is solved in a first aspect with a holding frame of the type mentioned in the introduction by the features of the characterizing part of independent main claim 1.

In a second aspect the problem is solved with a method of the type mentioned in the introduction by the features of the characterizing part of independent coordinated claim 9.

A holding frame of this type can be used in the field of heavy industrial plug-type connectors and can consist at least in part of an electrically conductive material. A protective earthing, in particular a PE protective earthing is thus made possible where appropriate, which can be realized for example in that the holding frame has a PE contact or at least is provided with a PE contact of this type.

The holding frame has a basic portion and a deformation portion, which are formed at least in part from different materials. The basic portion serves to fix a received module in a plane. The deformation portion can assume an insertion state and a holding state, wherein the insertion state allows at least one module to be inserted into the holding frame in a direction transverse to the plane, wherein in the holding state a received module is fixed.

The holding frame can have, by way of example, a basic frame as basic portion and at least one, preferably two cheek parts as deformation portion. The basic frame can then be formed from a different material compared with the cheek parts and therefore advantageously can have a lower elasticity and therefore a greater rigidity compared with the cheek parts.

The deformation portion, in particular the one or more cheek parts, can be formed from a material which is more elastic in accordance with its stress/strain graph, i.e. has a lower modulus of elasticity compared with the material from which the basic portion, in particular the basic frame, is formed. Expressed conversely, the material of the basic portion can be more rigid than the material from which the deformation portion is formed. By way of example, the material of the basic frame can have a modulus of elasticity, in accordance with its stress/strain graph, which is greater than the modulus of elasticity of the material from which the cheek parts are formed.

Here, the value of the modulus of elasticity is all the greater, the greater is the resistance put up by a material in opposition to the elastic deformation thereof. Furthermore, the material from which the deformation portion is formed, in accordance with the stress/strain graph thereof, can have a greater elastic range compared with the material from which the basic portion is formed.

In particular, the basic portion, in particular the basic frame, can be rigid, and in particular can be rigid in an idealized way.

Furthermore, the deformation portion, in particular the cheek part or the cheek parts, can be resilient and advantageously can be manufactured from a resilient sheet metal.

A resilient sheet metal is to be understood here to mean a sheet metal that has resilient properties, for example a reversible deformability, in particular with application of a corresponding restoring force, i.e. for example a sheet metal that is manufactured from spring steel or a comparable material.

Advantageous embodiments of the invention are specified in the dependent claims.

One advantage of the invention therefore lies in the fact that the modules can be individually inserted into the holding frame and removed therefrom again with only very little effort, which in particular facilitates the manual fitting of said modules. The resilient properties of the deformation portion, in particular of the cheek part or the cheek parts, specifically make it possible to insert or to remove modules individually with only very little effort. At the same time, the basic frame, as a result of its rigidity, can ensure the necessary mechanical stability when holding the inserted modules.

Use of one or more metal materials, for example compared with plastic, ensures high temperature resistance and furthermore also a particularly high mechanical robustness of the holding frame, which is advantageous both for the basic portion, in particular the basic frame, and for the deformation portion, in particular the cheek parts.

A further advantage of the use of one or more metal materials lies in the fact that the holding frame, for electrical safety, enables a protective earthing, in particular a PE protective earthing of a metal plug-type connector housing in which the holding frame is inserted. This furthermore also ensures, as an additional advantage, a shielding of the signals transmitted through the plug-type connector. This shielding may be a protection against interfering fields from outside. However, the shielding may also be a shielding for avoiding or reducing emitted interference, i.e. for protecting the environment against interfering fields of the plug-type connector. In other words, not only are the signals transmitted through the modules protected against external interfering fields, but there is also provided a protection of the surroundings from interference produced by a flow of current running through the modules.

A particularly great additional advantage of the use of one or more metal materials furthermore lies in the fact that the holding frame on the one hand is particularly heat-resistant and on the other hand, for example due to the use of resilient sheet metal, still has a sufficiently high elasticity at the necessary points to insert the modules individually and with little effort into the module frame and to remove these again. It is therefore particularly advantageous when the holding frame comprises resilient sheet metal at suitable points, since it is thus much more resistant to heat, with at least just as much elasticity, than a plastics frame which is otherwise functionally comparable from a mechanical viewpoint. Relevant modules can be designed in an accordingly compact manner, such that they can still be fabricated from plastic and are nevertheless relatively resistant to heat.

It is particularly advantageous when the holding frame has a plurality of different regions, for example a first and second region, which have a different elasticity from one another, because a higher section modulus can then be applied purposefully in the region of the highest bending load. The first region can correspond to the basic portion. The second region can correspond to the deformation portion.

These different regions, in particular the basic portion and the deformation portion, can be formed for example from different materials and can thus preferably have different material properties, in particular different moduli of elasticity.

The second region, in particular the deformation portion, can thus have a higher elasticity than the first region, which in particular corresponds to the basic portion. Expressed conversely, the first region can thus have a greater rigidity than the second region. In particular, the first region can be rigid and the second region can be resilient. An elasticity or rigidity of this type can be achieved on the one hand, as already mentioned, by the used material in question and/or can be achieved on the other hand also by the geometric shaping of these regions, in particular of the basic portion and of the deformation portion.

The first region, in particular the basic portion, can be formed for this purpose from a rigid material, for example from a zinc alloy or from an aluminum alloy or from a copper alloy. The second region, in particular the deformation portion, can be formed from a resilient material and therefore can consist by way of example of a resilient sheet steel.

The first region, in particular the basic portion, can be produced in a casting method, for example in a zinc diecasting or aluminum diecasting method or also by milling from, for example, a copper alloy. By way of example, the first region, in particular the basic portion, may preferably be the peripheral basic frame. The basic frame can thus be, in particular, a zinc diecast part. The basic frame can be substantially rectangular in cross section, i.e. has two mutually opposed end faces extending parallel to one another and, at right angles thereto, has two mutually opposed side parts extending parallel to one another, wherein the two end faces are shorter than the two side parts. Here, both the end faces and the side parts can have a substantially rectangular shape.

The second region, in particular the deformation portion, furthermore can be formed by way of example from the at least one, preferably both separate cheek parts, each of said cheek parts preferably consisting of a resilient sheet metal part. The two cheek parts can consist, where appropriate, of the same material, in particular of resilient sheet metal, and in addition can have the same thickness. By way of example, the preferably two cheek parts can be punched out from the same punching sheet.

Each cheek part can be substantially flat and can preferably have a rectangular basic shape. It thus has two mutually opposed, long edges, specifically a first and a second edge, and, at right angles thereto, two mutually opposed short edges, specifically a third and a fourth edge. The cheek part has preferably straight slots, in particular at regular distances starting on its first edge and extending preferably at right angles thereto into the cheek part in the direction of the second edge, whereby freely protruding tabs are formed in the cheek part. Furthermore, a detent window can be arranged as detent element in each of these tabs. These detent windows are intended to receive detent lugs of inserted modules in order to latch the modules in the holding frame. Furthermore, each cheek part can have a plurality of fastening elements, in particular fastening recesses, preferably of round shape, for fastening to the basic frame.

The two cheek parts can advantageously be fastened one to each outer side of the two side parts on the basic frame, such that two resilient tabs of the two cheek parts protrude symmetrically to one another in each case. Furthermore, these tabs can be bent slightly outwardly toward their end, i.e. away from the basic frame and thus away from one another, so as to facilitate the insertion of a module.

At the appropriate side part, preferably at both side parts, the basic frame can have fastening means, for example round fastening pins. These fastening means can engage with the fastening recesses of the relevant cheek part and can thus hold the cheek parts on the basic frame, for example by latching and/or by an interlocking and frictionally engaged connection. Additionally or alternatively, the cheek parts can be fastened to the basic frame by adhesive bonding, welding, soldering, riveting and/or screwing or by any other fastening method.

The appropriate modules can be substantially cuboidal and can have a width on each of two mutually opposed longitudinal sides corresponding to the width of a tab. Each module advantageously has, on each of its two end faces, a detent lug, which likewise can be substantially cuboidal. Each of the resilient tabs of the holding frame advantageously has a detent window, which can be substantially rectangular and which is intended to receive a detent lug of this type, preferably in an interlocking manner.

The two detent lugs of a module can differ from one another, for example in terms of their shape and/or their size, in particular by their length, and the tabs on both sides of the holding frame can have corresponding windows, which likewise differ from one another and which each fit one of the detent lugs in terms of size and/or shape. This has the advantage that the orientation of each module in the holding frame is fixed as a result. In other words, the detent windows and the detent lugs can be used on the basis of their shape and/or size as coding means, in particular as polarization means, for orientation of the modules in the holding frame.

The tabs of the holding frame are advantageously bent away slightly from the holding frame in a freely protruding end region, which simplifies the insertion of the modules. A module can then be inserted into the holding frame in a particularly user-friendly manner. For this purpose, a module specifically is firstly inserted between two tabs of a holding frame and then slides via its two side faces and in particular via the detent lugs integrally molded thereon along the end regions of the tabs bent away from one another. The two tabs thus bend temporarily away from one another until the detent lugs in question are received by the associated detent window of the relevant tab and therefore latch therein. As the detent lugs are received in the relevant detent windows, the tabs preferably spring back into their starting position. The modules can thus latch individually in the holding frame.

At the same time, the module is held fixedly in the preferably rigid basic frame. In order to unlatch the modules again, merely the two relevant tabs have to be bent away from one another again. The relevant module can then be removed individually from the holding frame, whereas the other modules are still latched. A fixed hold of the module in the holding frame alongside a comparatively low actuation force is thus ensured in this way, which is particularly advantageous for the handling.

It is also particularly advantageous that the modules are held with sufficient holding force in the holding frame already by the above-specified construction, and accordingly, besides their detent lugs, require no further detent means, for example detent arms, which facilitates their design and therefore their production effort considerably and at the same time ensures a compact design and therefore also a high heat resistance of the modules and therefore of the entire plug-type connector.

In one embodiment it is particularly advantageous when these two cheek parts are identical, i.e. in spite of the two-part embodiment of the holding frame only cheek parts of one type have to be produced, which in turn reduces the production effort.

In another preferred embodiment the two cheek parts differ at least by the size and/or the shape of their detent windows. This has the advantage that the orientation of each module, which accordingly also has two different detent lugs, is thus fixed. In other words, the detent windows and the detent lugs thus serve on account of their shape as coding means for orientation of the modules.

For earthing protection (PE), the holding frame can be provided with a corresponding PE module, which, for example via an electrically conductive earthing clip, produces electrical contact between an earthing cable attached thereto and the at least partly electrically conductive, in particular metal holding frame. The holding frame can thus be fitted with a PE contact.

Alternatively, the holding frame itself can have a PE contact, for example a screw contact, for the earthing cable. By way of example, a PE contact of this type can be integrally molded on the basic frame.

EXEMPLARY EMBODIMENT

Figure 2A:
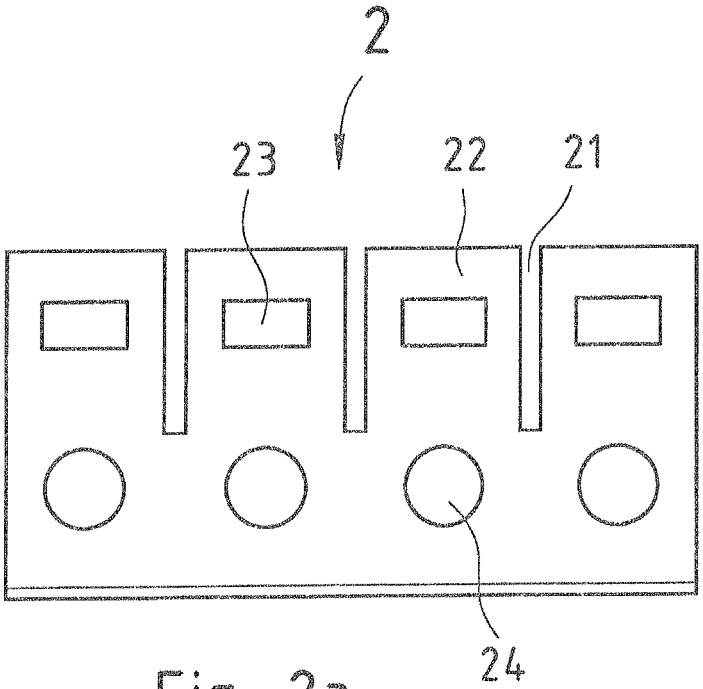
Figure 2B:
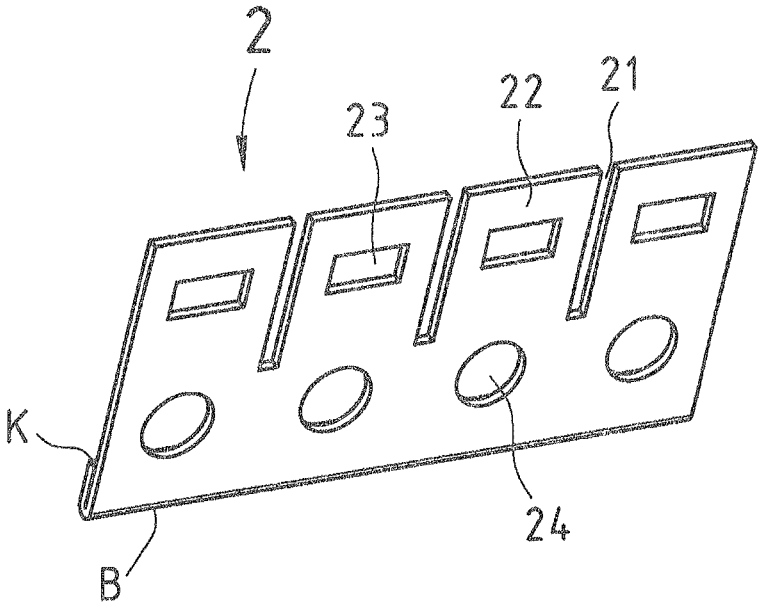
Figure 2C:
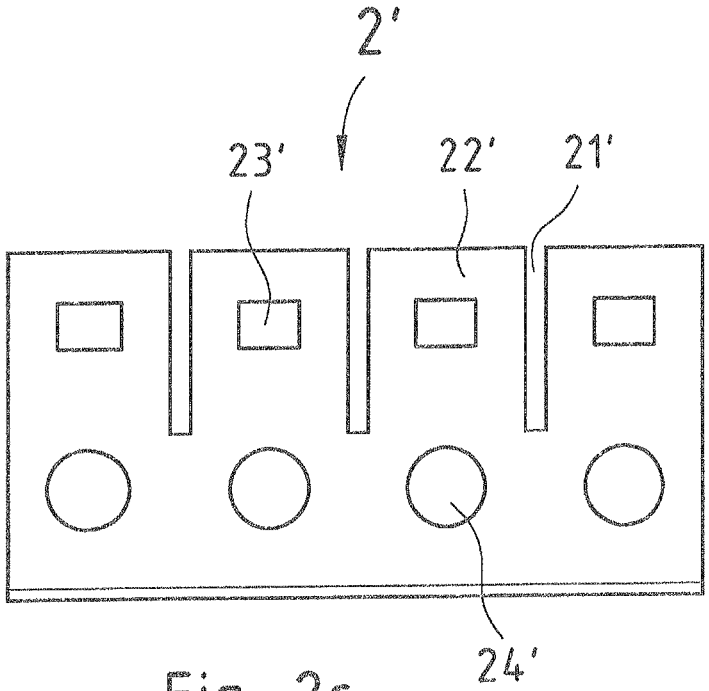
Figure 2D:
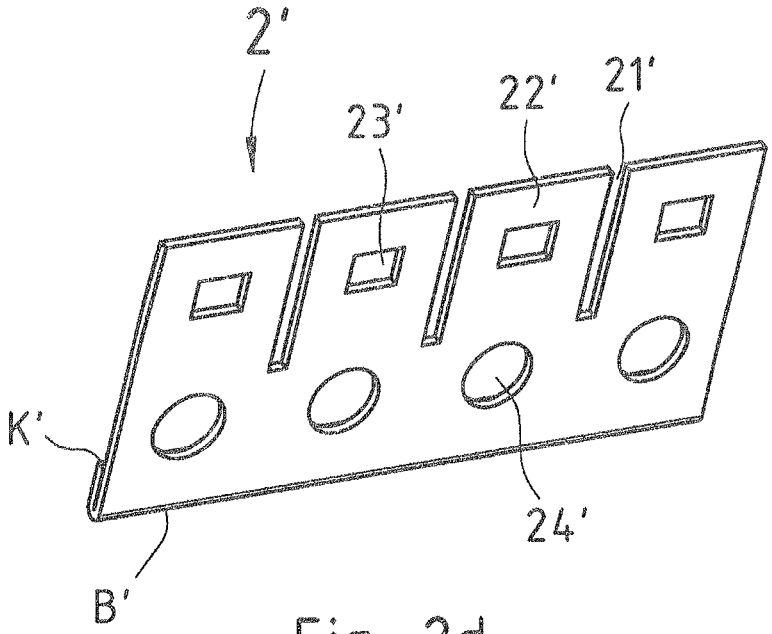
Figure 3A:
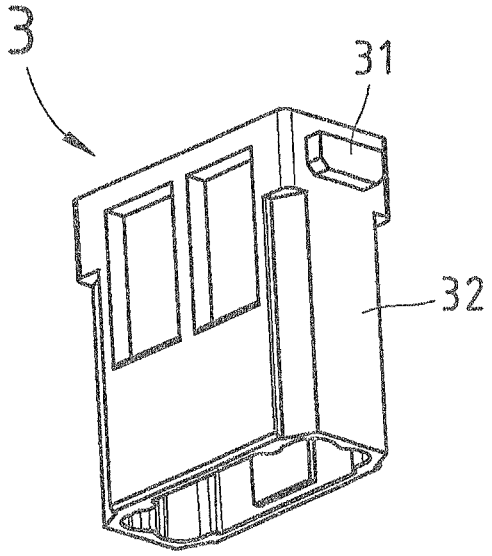
Figure 3B:
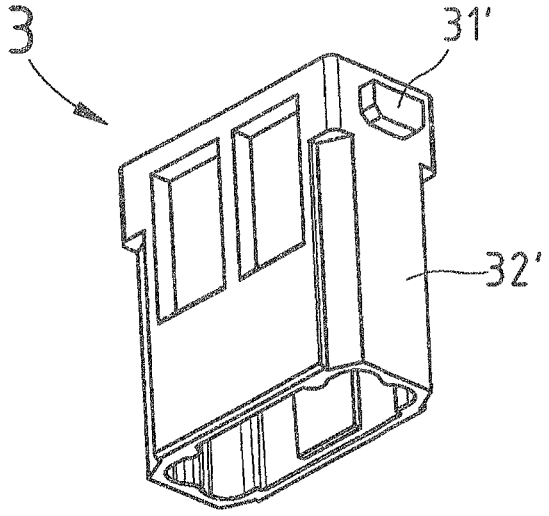
Figure 4A:
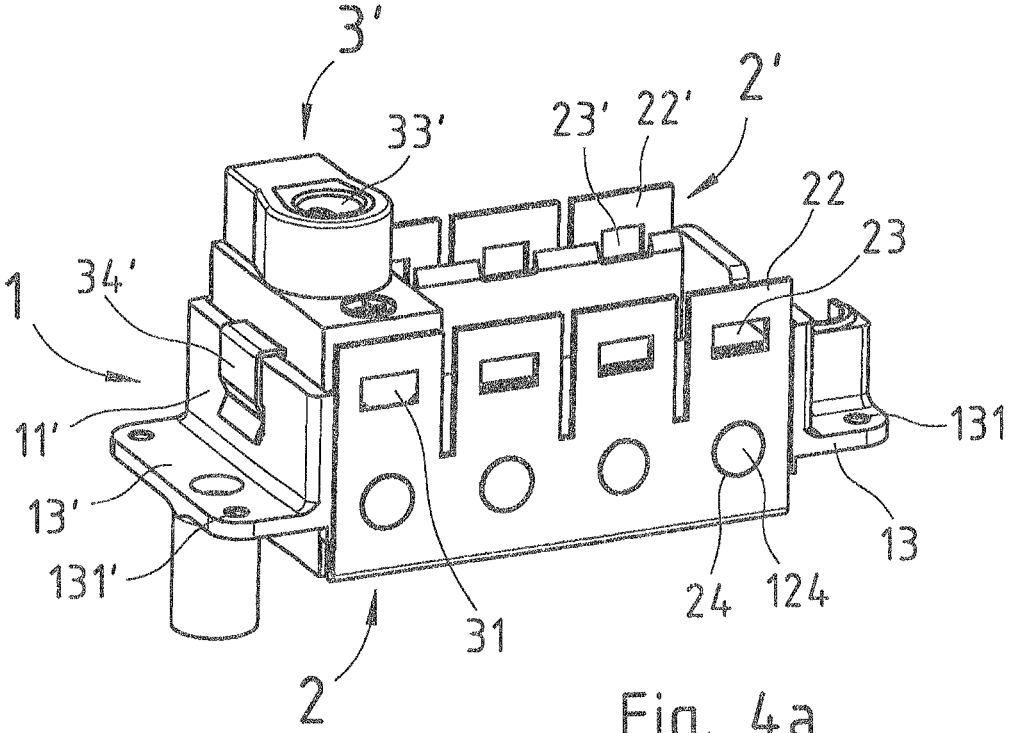
Figure 4B:
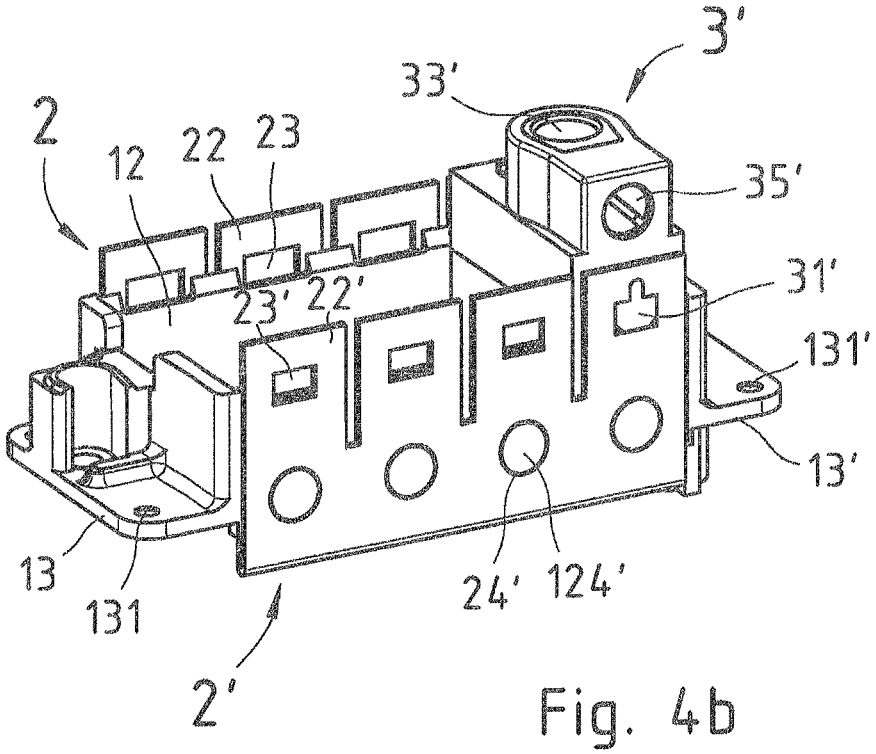

An exemplary embodiment of the invention is illustrated in the drawing and will be explained in greater detail hereinafter. In the drawing:

FIG. 1 shows a basic frame;

FIGS. 2*a* and 2*b* show a first cheek part from two different perspectives;

FIGS. 2*c* and 2*d* show a second cheek part from two different perspectives;

FIGS. 3*a* and 3*b* show a module from two different perspectives;

FIGS. 4*a* and 4*b* show a holding frame with an inserted PE module from two different perspectives.

FIG. 1 shows a basic frame 1. This basic frame 1 is substantially rectangular in cross section, i.e. has two mutually opposed end faces 11, 11' extending parallel to one another and, at right angles thereto, has two mutually opposed side parts 12, 12' extending parallel to one another, wherein the two end faces 11, 11' are shorter than the two side parts 12, 12'. Both the end faces 11, 11' and the side parts 12, 12' in turn have a substantially rectangular shape, wherein a flange 13, 13' is integrally molded onto each of the end faces 11, 11' at right angles thereto, wherein each of these two flanges 13, 13' has two screw bores 131, 131', such that the basic frame 1 has a total of four screw bores 131, 131'.

The two side parts 12, 12' each have, at a first edge, a plurality of webs 122, 122', which are relatively short in the present embodiment and which are arranged in a manner opposite one another symmetrically, wherein the term "short" in this context means that the length of the webs 122, 122 extending upwardly in the drawing is less than the width of said webs. However, the webs 122, 122' could also be much longer in a different embodiment. By way of example, the length of the webs could correspond to their width or could even exceed their width. Open recesses 123, 123' are thus formed between these webs 122, 122'.

In the present example four such open recesses 123, 123' are provided on each cheek part 2, 2', however it would also of course be conceivable to provide a different number of recesses, for example three, five, six, seven or eight. The number of open recesses 132, 132' in each side part 12, 12' corresponds to the number of modules 3 that the corresponding holding frame is able to receive.

Furthermore, each side part 12, 12' has a plurality of fastening pins 124, 124' for fastening the relevant cheek part 2, 2. In the present case the fastening pins 124, 124' have a circular shape in cross section; however, any other shape would also be conceivable; for example, the fastening pins 124, 124 could thus also be oval, rectangular, square, triangular or pentagonal, or could have n corners or could be formed in any other flat shape.

Two cheek parts 2, 2' are thus provided for the holding frame, specifically a first cheek part 2 and a second cheek part 2'.

FIGS. 2*a* and 2*c* each show one of these cheek parts 2, 2' in a first perspective, in which the viewing direction extends at right angles thereto. FIGS. 2*b* and 2*d* show, respectively, the cheek parts 2, 2' in an oblique view. Each cheek part 2, 2', which in the present exemplary embodiment is preferably a punched and bent part, has three slots 21, 21, by means of which four tabs 22, 22' of identical size are formed. The number of tabs 22, 22' of the cheek parts 2, 2' corresponds to the number of open recesses 123, 123' in each of the two side parts 12, 12' of the basic frame 1.

A detent window 23, 23' is provided in each tab 22, 22' of each cheek part 2, 2'. The detent windows 23 of the first cheek part 2 are larger than the detent windows 23' of the second cheek part 2'. The two cheek parts 2, 2' thus differ from one another by the size of their detent windows 23, 23'. Furthermore, additional fastening recesses 24, 24' are provided in the cheek parts 2, 2, which recesses have a circular shape in the present exemplary embodiment, but of course could also have any other shape, for example could be oval, rectangular, square, triangular or pentagonal, could have n corners, or could be formed in any other flat shape.

The fastening pins 124, 124' of the basic frame 1 fit in an interlocking manner into the fastening recesses 24, 24' of the cheek parts 2, 2' respectively, such that each cheek part 2, 2 can be fitted onto the relevant side part 12, 12'. Each cheek part 2, 2' can additionally also be fastened in another way to the corresponding side part 12, 12', for example by adhesive bonding, welding, soldering, riveting and/or screwing.

It can be seen in FIGS. 2*b* and 2*d* that the cheek parts 2, 2' in the lower end region are folded through 180° at a bending line B, B' and are therefore reinforced in this region. A lower edge K, K' of the associated sheet metal comes to lie here between the fastening recesses 24 and an associated bending line B, B', such that the fastening recesses 24, 24' are uncovered and the fastening pins 124, 124' can be inserted therein in an unhindered manner.

FIG. 3*a* and FIG. 3*b* show a possible design of a module 3 that can be inserted into the holding frame, from two different views. Of course, other modules of similar design can also be used.

The module 3 has, on a first longitudinal side 32, a first detent lug 31, which is intended to latch in a detent window 23 of the first cheek part 2. On a second longitudinal side 32' opposite this first longitudinal side 32, the module 3 has a second detent lug 31', which is narrower than the first detent lug and which is intended to latch in a detent window 23' of the second cheek part 2'. The module is also very compact, which improves the heat resistance thereof.

The orientation of the module 3 in the holding frame is fixed by the shape of the detent lugs 31, 31' and the shape of the windows 23, 23'.

FIG. 4 shows a fully assembled holding frame, in which the two cheek parts 2, 2' are thus fastened to the basic frame. Here, the fastening pins 124, 124' of the basic frame engage with the fastening recesses 24, 24' of the corresponding cheek part 2, 2'. In addition, a particular stability of this fastening is provided in that said lower edges K, K' of the sheet metal of the cheek parts 2, 2' terminate directly with the corresponding side part 12, 12 of the basic frame 1. Additionally or alternatively to the fastening by means of the fastening pins 124, 124' and the fastening recesses 24, 24', the cheek parts 2, 2' can also be soldered, welded, screwed or riveted to the basic frame 1, or can be fastened thereto in another way.

The cheek parts 2, 2' have, in particular in the region of their tabs 22, 22', a greater elasticity than the basic frame 1. Expressed conversely, the basic frame 1, which can be produced in a diecasting method, in particular a zinc diecasting method, has a greater rigidity than the two resilient cheek parts 2, 2', which for example can consist of resilient sheet steel.

This means that a certain force, for example of 10 N, which acts on any tab 22 of a cheek part 2 at the height of the detent window 23 thereof at right angles to the surface of the cheek part 2, directed from the inside out with respect to the holding frame, causes a deflection of the tab 22 to be measured in line with the detent window 23 thereof, which deflection is greater than the deflection experienced by the basic frame 1 at any arbitrary point when a force of equal strength, for example likewise of 10 N, acts on this arbitrary point perpendicularly to the end face 11, 11' or side part 12, 12' of said basic frame, directed from the inside out with respect to the basic frame.

The basic frame 1 thus has a greater rigidity than the cheek parts 2, 2'. Expressed conversely, the cheek parts 2, 2 have a higher elasticity than the basic frame.

The following disclosure is provided on the understanding that the holding frame is fixed at four corner points. By way of example, it can be fixed in or to a metal plug-type connector housing by screwing at the four screw bores 131, 131' in the flanges 13, 13' of said holding frame.

If, for example, a force of 10 N acts on the tab 22 of a cheek part 2 at the level of the detent window 23 thereof at right angles to the surface of the cheek part 2, this tab 22 will be reversibly deflected for example over a path of least 0.2 mm, preferably at least 0.4 mm, in particular at least 0.8 mm, i.e. for example more than 1.6 mm. If a force of equal magnitude of 10 N for example acts in the middle of a side part 12 perpendicularly to the surface of the side part 12, acting from the inside out with respect to the basic frame 1, the basic frame 1 will thus be deflected even in this region, in which the rigidity of said basic frame is minimal, only over a path of less than 0.2 mm, preferably less than 0.1 mm, in particular less than 0.05 mm, i.e. for example less than 0.025 mm. The basic frame 1 is thus more rigid than the cheek parts 2, 2'. In particular, the basic frame 1 is considered to be rigid and the cheek parts 2, 2' are each said to be resilient.

A holding and in particular a latching of the modules is thus provided with high holding force alongside low actuation forces, which significantly facilitates the handling, in particular the insertion and removal of individual modules 3. Lastly, the cheek part 2 is resilient, and the elasticity of the cheek part 2 is selected in particular in accordance with the above-specified values such that the modules 3 can be manually inserted and manually removed. At the same time, the basic frame 1 is rigid, and in particular the rigidity of the basic frame 1 is so high, in particular in accordance with the above-specified values, that the inserted modules 3 are held therein with sufficient strength to ensure the intended function of an associated plug-type connector. The modules 3 and therefore contacts also provided in the modules 3 are thus, specifically, positioned with sufficient geometric accuracy and sufficient mechanical stability to reliably electrically contact corresponding mating contacts of a comparable mating plug.

Such a plug-type connector and a corresponding mating plug, which are not illustrated in the drawing, can additionally have a preferably metal housing, in which a holding frame fitted fully or partially with modules 3 is inserted.

In the holding frame illustrated in FIGS. 4*a* and 4*b*, a specially designed PE module 3' is held, which corresponds in terms of its basic shape to the module 3 illustrated in FIGS. 3*a* and 3*b*. In addition, the PE module 3' has an electrically conductive PE contact 33', which is electrically conductively connected via the PE module 3' to an electrically conductive earthing clip 34' likewise belonging to the PE module 3'. The PE contact 33' can be, for example, a screw contact, i.e. the PE contact 33' has an earthing screw 35', which is suitable for conductively connecting an earthing cable to the PE contact 33' and for mechanically fixing said cable to said contact. This earthing cable is electrically conductively connected to the basic frame by the PE module 3' via the earthing clip 34' thereof, which is clamped to one of the end faces 11' of the holding frame.

Alternatively, the holding frame itself can have a PE contact of this type, for example a PE screw contact, on its basic frame 1. The PE contact can be integrally molded on the basic frame 1, for example. This can be implemented already during the production of the basic frame 1, for example by means of injection molding.

The invention, however, is in no way limited to this embodiment. Rather, a multiplicity of further embodiments are disclosed, in particular by the following characterizing features and by expedient combination thereof:

The holding frame serves to receive modules 3 of the same type and/or, different modules 3, wherein the holding frame can be formed from at least two different materials, of which at least one material is electrically conductive. The holding frame advantageously has resilient properties at least in part. In particular, the holding frame can consist in part of a rigid material and in part of a resilient material.

By way of example, the holding frame can be formed in a number of parts. The holding frame can consist of at least two parts, of which a first part is formed of a first material and a second part is formed of a second material, wherein the modulus of elasticity of the first material is greater than the modulus of elasticity of the second material.

By way of example, the first part can be formed as a basic frame 1 and the second part can be formed as a cheek part 2, 2'. The basic frame 1 can be rectangular in cross section and can have two mutually opposed side parts 12, 12' extending parallel to one another and two opposed end faces 11, 11' arranged perpendicularly to said side parts and extending parallel to one another. In particular, the basic frame 1 can be rigid. The basic frame 1 can be formed in one piece. The basic frame 1 can be formed as a diecast part. The at least one cheek part 2, 2' can be resilient. The at least one cheek part 2, 2' can be electrically conductive and can also consist of resilient sheet metal.

The at least one cheek part 2, 2' can be fastened to the basic frame 1, for example by adhesive bonding, welding, soldering, riveting, latching and/or screwing. The at least one cheek part 2, 2' can have a plurality of slots 21, 21', by means of which tabs 22, 22' are formed in the cheek parts 2, 2'. Here, the width of the tabs 22, 22' can correspond to the width of the modules 3. In particular, all tabs 22, 22' can have the same width. Each tab 22, 22' can have a detent means. The detent means can consist of a detent window 23, 23', which is arranged in the relevant tab 22, 22'. The at least one cheek part 2, 2' can be, in particular, a punched and bent part. The at least one cheek part 2, 2' can be constituted by two cheek parts 2, 2'. The holding frame can have a protective earthing contact (PE contact) or can be provided with at least one such contact.

During production thereof, the holding frame, which is intended for a plug-type connector and is suitable for receiving modules 3 of the same type and/or different modules 3, can be formed from at least two different materials.

At least a first part of the holding frame, specifically a basic frame 1, can be produced here in a diecasting method, in particular in a zinc diecasting method.

The at least one cheek part 2, 2' can be punched out from a resilient sheet metal and in particular can be folded through 180° at least at one bending edge B, B'.

The at least one cheek part 2, 2' can be fastened to the basic frame 1, in particular by adhesive bonding, welding, soldering, riveting, latching and/or screwing.

The holding frame, by means of its basic frame, can hold a module 3 received therein in one direction and at the same time can fix this module 3 perpendicularly to said direction by means of tabs 13, 13', 23, 23' belonging to the relevant cheek part 2, 2', in particular by latching the module 3 at the tabs 22, 22' thereof.

LIST OF REFERENCE SIGNS

1 basic frame
11, 11' end faces
12, 12' side parts
122, 122' webs

123, 123' open recesses
124, 124' fastening pins
13, 13' flanges
131, 131' screw bores
2, 2' cheek parts
21, 21' slots
22, 22' tabs
23, 23' detent windows
24, 24' fastening recesses
B, B' bending line
K, K' lower edge
3 module
3' PE module
31, 31' detent lugs
32, 32' front faces
33' PE contact
34' earthing clip
35' earthing screw

The invention claimed is:

1. A holding frame for a plug-type connector for receiving connector modules, the holding frame comprising:

a rigid frame formed from a first material and including longitudinal sidewalls and transverse end walls that define a rectangular frame structure that is configured to insertably receive the connector modules, each of the longitudinal sidewalls including a plurality of upwardly extending protrusions that are arranged to define open recesses spaced apart along a longitudinal length at an upper end of the longitudinal sidewall between the upwardly extending protrusions which are configured to receive lugs of the connector modules that extend transversely toward the longitudinal sidewall when the connector modules are received in the rectangular frame structure, a lower end of each of the open recesses being defined by the upper end of the longitudinal sidewall and opposing sides of each of the open recesses being defined by lateral sides of the upwardly extending protrusions, and wherein each of the open recesses extends completely through the longitudinal sidewall; and resilient cheek parts distinct from each other and distinct from but coupled to the longitudinal sidewalls of the rigid frame which are adapted to assume an insertion state and a holding state, wherein:

the resilient cheek parts in the insertion state are adapted to allow at least one of the connector modules to be inserted into the rigid frame in an insertion direction, and in the holding state are adapted to fix the at least one of the connector modules in place within the rigid frame, the resilient cheek parts are formed from a second material that is different from the first material of the rigid frame, at least a portion of each of the resilient parts is arranged to extend externally along a respective one of the longitudinal sidewalls of the rigid frame to provide a multi-layer sidewall structure, each of the resilient parts includes an upper portion with at least one detent window which is aligned with a respective one of the open recesses such that the detent window at least partially overlaps with one of the open recesses when viewing the holding frame perpendicular to the longitudinal sidewalls, and the upper portion of each of the resilient parts is adapted to move outwardly away from the rigid frame when moving to the insertion state to receive one of the lugs of the connector modules.

2. The holding frame as claimed in claim 1, wherein the rigid frame and the resilient cheek parts are adhesively bonded, welded, soldered, riveted, latched or screwed together.

3. The holding frame as claimed in claim 1, wherein the resilient cheek parts are designed for an elastic deformation between the insertion state and the holding state.

4. The holding frame as claimed in claim 1, wherein each of the resilient parts further includes a lower portion coupled to a respective one of the longitudinal sidewalls of the rigid frame.

5. The holding frame as claimed in claim 1, wherein the upper portion of each of the resilient parts includes a plurality of tabs each having a free end configured to flex outwardly away from the rigid frame independent of each other.

6. The holding frame as claimed in claim 5, wherein each of the plurality of tabs of each of the resilient parts includes a respective detent window for receiving a corresponding lug of one of the connector modules, and wherein the at least one detent window of each of the resilient part is provided by the respective detent windows of the plurality of tabs.

7. The holding frame as claimed in claim 5, wherein each of the plurality of tabs of each of the resilient cheek parts is separated from an adjacent one of the tabs by an elongate slot.

8. A holding frame for a plug-type connector for installing in a metallic plug-type connector housing, the holding frame comprising:

a rigid die-cast metal frame including longitudinal sidewalls and transverse end walls that define a rectangular frame structure that is configured to receive a plurality of connector modules, each of the longitudinal sidewalls including a plurality of upwardly extending protrusions that are arranged to define open recesses spaced apart along a longitudinal length at an upper end of the longitudinal sidewall between the upwardly extending protrusions which are configured to receive lugs of the connector modules that extend transversely toward the longitudinal sidewall when the connector modules are received in the rectangular frame structure, a lower end of each of the open recesses being defined by the upper end of the longitudinal sidewall and opposing sides of each of the open recesses being defined by lateral sides of the upwardly extending protrusions, and wherein each of the open recesses extends completely through the longitudinal sidewall; and cheek parts made of resilient sheet metal, the cheek parts being distinct from each other and distinct from but coupled to the rigid die-cast metal frame to extend along opposing exterior sides of the longitudinal sidewalls of the rigid die-cast metal frame to provide a multi-layer sidewall structure, and each of the cheek parts having an upper portion with at least one detent window which is aligned with a respective one of the open recesses such that the detent window at least partially overlaps with one of the open recesses when viewing the holding frame perpendicular to the longitudinal sidewalls, and wherein the upper portion of each of the resilient parts is configured to flex outwardly to an insertion state to receive one of the lugs of the plurality of connector modules and to return to a holding state to lock the connector module in place within the rigid die-cast metal frame.

9. The holding frame as claimed in claim 8, wherein each of the cheek parts further includes a lower portion coupled to a respective one of the longitudinal sidewalls of the rigid die-cast metal frame.

10. The holding frame as claimed in claim 8, wherein the upper portion of each of the cheek parts includes a plurality of tabs each having a free end configured to flex outwardly away from the rigid die-cast metal frame independent of each other.

11. The holding frame as claimed in claim 10, wherein each of the plurality of tabs of each of the cheek parts includes a respective detent window for receiving a corresponding lug of one of the connector modules, and wherein the at least one detent window of each of the cheek parts is provided by the detent windows of the plurality of tabs.

12. The holding frame as claimed in claim 10, wherein each of the plurality of tabs of each of the cheek parts is separated from an adjacent one of the tabs by an elongate slot.

13. The holding frame as claimed in claim 8, wherein each of the cheek parts is of substantially flat design and has a rectangular basic shape.

14. The holding frame as claimed in claim 8, wherein each of the cheek parts has straight slots that are spaced at regular distances across a width of the cheek part and extend from a free end of the cheek part toward a base end of the cheek part to form protruding tabs.

15. The holding frame as claimed in claim 8, wherein each of the cheek parts is a punched and bent part.

16. The holding frame as claimed in claim 8, wherein each of the cheek parts includes a 180° folded edge at a lower end of the cheek part such that the lower end includes parallel and laterally offset lower end cheek portions.

17. The holding frame as claimed in claim 8, wherein the plurality of upwardly extending protrusions of each of the longitudinal sidewalls are arranged in a manner opposite one another symmetrically.

18. The holding frame as claimed in claim 8, wherein, for each of the longitudinal sidewalls of the rigid die-cast metal frame, each of the upwardly extending protrusions have a common length and a common width, and wherein the common length exceeds the common width.

19. The holding frame as claimed in claim 8, wherein, for each of the longitudinal sidewalls of the rigid die-cast metal frame, each of the upwardly extending protrusions have a common length and a common width, and wherein the common length is the same or less than the common width.

20. The holding frame as claimed in claim 8, wherein the open recesses between each of the upwardly extending protrusions of one of the longitudinal sidewalls of the rigid die-cast metal frame have a common width that is different than a common width of the open recesses between each of the upwardly extending protrusions of the other one of the longitudinal sidewalls of the rigid die-cast metal frame.

21. The holding frame as claimed in claim 8, wherein portions of the rigid die-cast metal frame adjacent the open recesses cooperate with the detent windows formed in the cheek parts to collectively form lug receiving devices in the holding frame.

22. The holding frame as claimed in claim 8, wherein a respective flange is integrally die-cast with each of the transverse end walls of the rigid die-cast metal frame to extend at a right angle from the transverse end wall, and wherein each of the flanges has a plurality of apertures for securing the holding frame to a metallic plug-type connector housing.

23. The holding frame as claimed in claim 8, further comprising a protective earthing contact.

24. The holding frame as claimed in claim 8, wherein portions of each of the cheek parts on each of opposing sides of the at least one detent window provided in the cheek part are immediately adjacent to a respective one of the longitudinal sidewalls of the rigid die-cast metal frame without any intermediate structure between each of the cheek parts and the respective one of the longitudinal sidewalls when the connector modules are received in the rigid die-cast metal frame and the cheek parts are in the holding state.

25. The holding frame as claimed in claim 8, wherein a cavity having a perimeter defined by the longitudinal sidewalls and transverse end walls of the rigid die-cast metal frame extends completely through the rectangular frame structure of the rigid die-cast metal frame from one of opposing sides of the rigid die-cast metal frame to the other one of the opposing sides of the rigid die-cast metal frame such that no material of the rigid die-cast metal frame is provided within confines of the longitudinal sidewalls and transverse end walls of the rigid die-cast metal frame.

26. The holding frame as claimed in claim 21, wherein, for each of the resilient parts, the at least one detent window is directly aligned with the respective one of the open recesses.

27. The holding frame as claimed in claim 21, wherein, for each of the resilient parts, the at least one detent window is aligned with the respective one of the open recesses such that the detent window substantially overlaps with the respective one of the open recesses when viewing the holding frame perpendicular to the longitudinal sidewalls.

28. A holding frame for a plug-type connector for installing in a metallic plug-type connector housing, the holding frame comprising:

a rigid metal frame including longitudinal sidewalls and transverse end walls that define a rectangular frame structure that is configured to receive a plurality of connector modules, each of the longitudinal sidewalls including a plurality of upwardly extending protrusions that are arranged to define open recesses spaced apart along a longitudinal length at an upper end of the longitudinal sidewall between the upwardly extending protrusions which are configured to receive lugs of the connector modules that extend transversely toward the longitudinal sidewall when the connector modules are received in the rectangular frame structure, a lower end of each of the open recesses being defined by the upper end of the longitudinal sidewall and opposing sides of each of the open recesses being defined by lateral sides of the upwardly extending protrusions, and wherein each of the open recesses extends completely through the longitudinal sidewall; and cheek parts made of resilient sheet metal, the cheek parts being distinct from each other and distinct from but coupled to the rigid metal frame to extend along opposing exterior sides of the longitudinal sidewalls of the rigid metal frame to provide a multi-layer sidewall structure, each of the cheek parts having an upper portion with at least one detent window which is aligned with a respective one of the open recesses such that the detent window at least partially overlaps with one of the open recesses when viewing the holding frame perpendicular to the longitudinal sidewalls, and wherein the upper portion of each of the cheek parts is configured to flex outwardly to an insertion state to receive one of the lugs of the plurality of connector modules and to return to a holding state to lock the connector module in place within the rigid metal frame, and wherein portions of each of the cheek parts on each of opposing sides of the at least one detent window provided in the cheek part are immediately adjacent to a respective one of the longitudinal sidewalls of the rigid metal frame without any intermediate structure between each of the cheek parts and the respective one of the longitudinal sidewalls when the connector modules are received in the rigid metal frame and the cheek parts are in the holding state.

29. The holding frame as claimed in claim 28, wherein portions of the longitudinal sidewalls of the rectangular frame structure of the rigid metal frame adjacent the open recesses cooperate with the detent windows in the cheek parts to collectively form lug receiving devices configured to secure the connector modules within the rectangular frame structure of the rigid metal frame.

30. The holding frame as claimed in claim 28, wherein a cavity having a perimeter defined by the longitudinal sidewalls and transverse end walls of the rigid metal frame extends completely through the rectangular frame structure of the rigid metal frame from one of opposing sides of the rigid metal frame to the other one of the opposing sides of the rigid metal frame such that no material of the rigid metal frame is provided within confines of the longitudinal sidewalls and transverse end walls of the rigid metal frame.

* * * * *